United States Patent [19]

Jaros et al.

[11] Patent Number: 4,731,987

[45] Date of Patent: Mar. 22, 1988

[54] OPEN-END ROTOR SPINNING UNIT

[75] Inventors: Frantisek Jaros, Ústí nad Orlicí ; Miloslav Kubovy, Dolní Dobrouc; Květa Hácová, Ústí nad Orlicí ; Zdeněk Kotrba, Ústí nad Orlicí ; Pavel Bureš, Ústí nad Orlicí ; Jiří Štorek, Ústí nad Orlicí ; František Hortlík, Ústí nad Orlicí, all of Czechoslovakia

[73] Assignee: Vyzkumny Ustav Bavlnarsky, Usti Nad Orlici, Czechoslovakia

[21] Appl. No.: 67,060

[22] Filed: Jun. 25, 1987

[30] Foreign Application Priority Data

Jun. 27, 1986 [CS] Czechoslovakia ..... 4787-86

[51] Int. Cl.[4] ..... D01H 7/892; D01H 1/135; D01H 7/882

[52] U.S. Cl. ..... 57/415; 57/411; 57/414; 57/417

[58] Field of Search ..... 57/404, 406, 407, 408, 57/411, 414–417

[56] References Cited

U.S. PATENT DOCUMENTS

| | | | |
|---|---|---|---|
| 3,624,994 | 12/1971 | Rohlena et al. | 57/411 |
| 3,698,175 | 10/1972 | Dykast | 57/415 |
| 3,798,886 | 3/1974 | Rajnoha et al. | 57/416 X |
| 3,837,153 | 9/1974 | Didek et al. | 57/415 X |
| 3,845,612 | 11/1974 | Chisholm et al. | 57/416 X |
| 3,908,349 | 9/1975 | Urifu et al. | 57/414 |
| 3,952,494 | 4/1976 | Junek et al. | 57/415 X |
| 4,384,451 | 5/1983 | Elias et al. | 57/415 X |
| 4,471,608 | 9/1984 | Kawabata et al. | 57/411 X |
| 4,489,547 | 12/1984 | Kawabata et al. | 57/415 |
| 4,510,745 | 4/1985 | Kawabata et al. | 57/415 |

FOREIGN PATENT DOCUMENTS

| | | |
|---|---|---|
| 135732 | 3/1970 | Czechoslovakia . |
| 1940199 | 8/1970 | Fed. Rep. of Germany . |

*Primary Examiner*—John Petrakes

[57] ABSTRACT

The invention relates to an open-end rotor spinning unit and particularly solves the problem of the relationship between a fiber defining stud of a separator, a fiber supply duct and a yarn take-off duct passing through the separator and the stud.

According to the invention, there is established a dimensional relationship of the defining stud to the mean staple length of fibers, and the orientation of the supply duct at an acute angle to the front wall of a cylindrical projection partially engaging into the spinning rotor.

In inner section of the peripheral wall of the defining stud is curved in the direction of a natural fiber flow trajectory into the direction of the spinning rotor rotation while the outer section is either in contact with or radially set back from the cylindrical wall of the projection at a distance of up to 4 millimeters from the edge of the wall.

10 Claims, 6 Drawing Figures

OPEN-END ROTOR SPINNING UNIT

FIELD OF THE INVENTION

The invention relates to an open-end spinning unit, comprising a spinning rotor, a cylindrical projection partially engaging into said spinning rotor, a separator supported by said cylindrical projection, a defining stud for defining, in vertical direction, a fiber directing gap between the lower wall of said separator and the front wall of said cylindrical projection and also for fixing the separator, a fiber supply duct extending from a fiber opening cylinder and intersecting the front wall of said cylindrical projection at an acute angle, and a fiber take-off duct passing through said separator, said cylindrical projection and said defining stud; said separator and said cylindrical projection being coaxial with each other and with the spinning rotor while the geometric center of cross-sectional area of said defining stud is situated eccentrically to the spinning rotor axis.

BACKGROUND OF THE INVENTION

Hitherto known devices for conveying fibers into the spinning rotor substantially consist of a supply duct which is usually oriented tangentially to a fiber opening cylinder and opens either in the immediate proximity of the sliding wall of the spinning rotor, or in the space below a separator designed for separating the fiber supply region from the yarn take-off region of the spinning unit. The latter fiber supply device is the more preferable one because of preventing fibers from wrapping about the final yarn product as it is being withdrawn and, because of better guiding of the fibers onto the sliding wall of spinning rotor.

To avoid an increase of axial force on the yarn, and particularly when using high-speed spinning rotors, the diameters thereof have to be reduced. Since simultaneously the diameter of the cylindrical cover projection is to be shortened, the space for the outlet of the fiber supply duct is also reduced. Should the inner diameter of the fiber supply duct be kept in its desired size, it is necessary to reduce the diameter of a separator stud through which the yarn take-off duct is led, which in turn results in the fibers, especially of long staple, tending to wrap about said separator stud. To such fibers, other fibers adhere, thus producing fiber accumulations, increasing linear yarn weight non-uniformity, or choking the directing gap below the separator, and finally causing yarn breaks.

According to the West-German Published Application (DE-OS) No. 1,940,199, this problem is solved by a radial partition provided in the space between the separator and the front wall of the cylindrical cover projectin. Such a measure, however, gives rise to a resistance to air flow adjacent the outlet of the supply duct where an air whirl is produced while fibers are braked and wrinkle before contacting the slide wall of the spinning rotor. Apart from this, a fan for producing a fiber conveying air flow lays relative high claims on power.

In another apparatus described in British patent specification No. 1,411,878 (corresponding to U.S. Pat. No. 3,952,494), the separator is attached to the cylindrical cover projection by means of a stud eccentrically disposed relative to the axis of said projection. In this embodiment it is necessary to withdraw the yarn through an opening which is axial to the spinning rotor and disposed at the separator side opposite the supply duct outlet, which makes the mounting and the drive of the spinning rotor difficult and expensive. Because of a relatively small diameter of the separator supporting stud, long staple fibers tend to wrap about it and cause disadvantages as hereinabove referred to.

In the spinning unit described in the Czechoslovak Pat. No. 135,732, the spinning rotor interior partly accommodates the cylindrical projection together with the outlet of the fiber supply duct which supports the separator. Through the axis of said separator, which is identical with the spinning rotor axis, there is led the yarn take-off duct passing through a defining stud, which is designed for defining in the vertical direction, a directing gap between the lower separator wall and the front wall of the cylindrical projection in the region of the supply duct outlet and which simultaneously serves for fixing the separator. The geometric center of cross-sectional area of the defining stud is eccentric relative to the take-off duct and the cylindrical projection. The directing gap is defined by the vertically aligned peripheral wall of the defining stud, the outlet of the supply duct forming a conical opening practically on the entire free front wall of the cylindrical projection. This outlet is relatively short and is immediately associated with the fiber opening cylinder. The defining stud is an integral part of the separator and bears on the planar surface of front wall of the cylindrical projection.

A disadvantage of the aforedescribed arrangement is that fibers are caught in a gap between the front wall of the cylindrical projection and the lower wall of the defining stud. Apart from some impreciseness of manufacture, this is also caused because the supply duct has a relatively short outlet which is perpendicular to the front wall of the cylindrical projection whereby the leading ends of long staple fibers get into contact with the sliding wall of the spinning rotor as early as at the instant when their relatively long lengths are still engaged by the opening cylinder. An inner planar section of the peripheral wall of the defining stud directs the fibers immediately onto the spinning rotor. By passing over a sharp edge of transition between said planar section and an outer peripheral wall of said stud, the fibers are braked and tend to wrap about the defining stud since the relationship between the entire periphery of the defining stud and the fiber staple length has not been taken into account.

SUMMARY OF THE INVENTION

It is an object of the present invention to improve the structure of the defining stud and of the directing gap as described in the above Czechoslovak patent so as to be in a proper relationship to the fiber supply outlet and to the withdrawal of final yarn through the take-off duct led through the separator and the defining stud. In this way, the fibers are prevented from wrapping about the defining stud and from accumulating in the gap between said stud and the front wall of the cylindrical projection whereby the transport of fibers from the supply duct onto the sliding wall of spinning rotor and, consequently, the yarn quality are improved.

According to one aspect of the invention, the defining stud has a peripheral wall whose length corresponds at least to the half average staple length of fibers supplied through the supply duct, said peripheral wall being divided into an inner section facing the outlet of the supply duct, an an outer section situated at the opposite side of the cylindrical projection, said inner section being curved in the direction of the natural fiber flow trajectory merging into the direction of the spinning rotor rotation, while the outer section is in contact with or radially set back to the cylindrical wall of said projection at a distance of up to 4 millimeters.

Since the periphery of the defining stud has a length which is equal to or longer than half the mean fiber staple length, it is thereby possible to reduce the possibility of fibers wrapping about the defining stud.

In this way, the disadvantages of the prior art has hereinabove set forth are eliminated since the transfer of fibers from the outlet of the supply duct, intersecting the front wall of the cylindrical projection at an acute angle to the sliding wall, is optimal, and fibers bend themselves at their initial contact with said wall in the direction of spinning rotor rotation, without first getting into contact with the peripheral wall of the defining stud. Because of the elimination of horizontal gaps, no capture of fibers occurs.

The peripheral wall of the defining stud can be either cylindrical, which is the simplest shape from the viewpoint of manufacture, or the inner section of said wall extending between the take-off duct and the supply duct has, at most, the same radius of curvature as the outer section thereof. The latter embodiment is advantageous in that the thus shaped defining stud fills up an ineffective space of the defining gap while generating an effective air flow influencing the fiber transfer to the spinning rotor. This is achieved by appropriate dimensional limitations in that the outer section of the peripheral wall follows the cylindrical wall of the projection concurrently at a distance of from one to 4 millimeteres, and that said inner section is spaced apart from the adjacent edge of the outlet of the supply duct at a distance of up to 5 millimeters.

To avoid horizontal gaps, the defining stud can form an integral part of the separator and engage into a recess in the front wall of the cylindrical projection.

For the sake of a simple arrangement of the separator and the attachment thereof, the defining stud can form an integral part of the cylindrical projection and engage into a recess in the separator.

In an especially preferable embodiment, the defining stud is composed of a concentric shell about the yarn take-off duct, and a defining filling for filling up a part of a space between the lower wall of the separator and the front wall of the cylindrical projection, said filling being drawn over the concentric shell. This embodiment enables also conventional separators to be availed of, and a desired fiber transfer into the spinning rotor to be obtained. Apart from this, it is possible to equip conventional open-end spinning machines with such defining fillings which, due to the fact that they are preferably made of elastic material such as rubber or synthetics, perfectly fill up the respective space and adhere to the adjacent walls. Preferably, the elastic filling engages into a recess in the front wall of the cylindrical projection as well as into a recess in the lower wall of the separator.

The following coassigned U.S. patents are related to the present application and the disclosures of said patents is incorporated herein by reference: U.S. Pat. Nos. 4,369,620 to Burysek et al; 4,384,451 to Elias et al; 4,429,522 to Ferkl et al; 4,495,762 to Junek et al; and 4,499,718 to Junek et al.

BRIEF DESCRIPTION OF THE DRAWING

With these and other objects in view, which will become apparent in the following detailed description, the present invention, which is shown by example only, will be clearly understood in connection with the accompanying drawing, in which.

DESCRIPTION OF THE PREFERRED EMBODIMENTS

Figure 1:
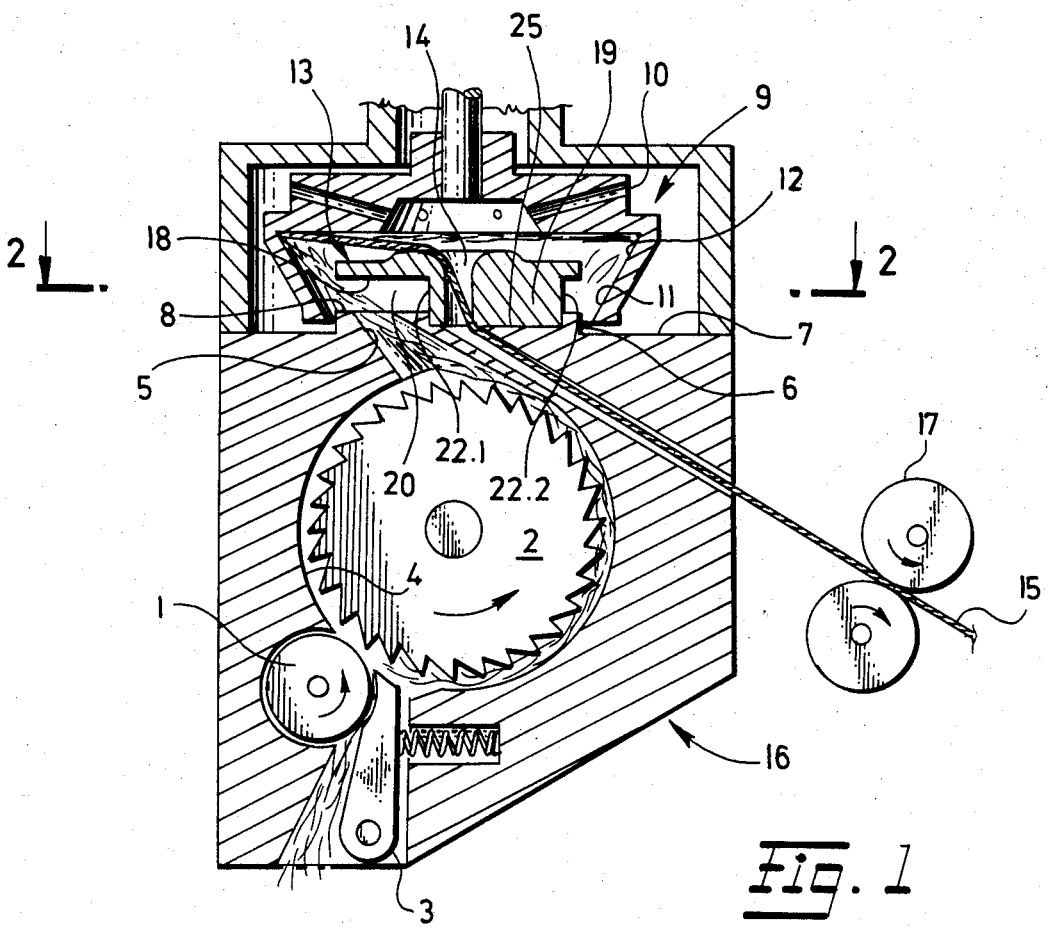
FIG. 1 is an axial sectional view of an open-end rotor spinning unit.

FIG. 1 shows an open-end rotor spinning unit having a rotary feed roller 1 and a fiber opening cylinder 2 which are driven by means not shown in the figures. The feed roller 1 is associated with a pressure shoe 3 resiliently thrusted thereto. A recess 4 in the spinning unit housing designed for the opening cylinder 2, merges into a fiber supply duct 5 which is led through a cylindrical projection 6 partially engaging into a spinning rotor 9, and intersects at an acute angle the front wall 8 of said cylindrical projection 6. The projection 6 projects from a wall 7 of a cover confining the spinning rotor space. In this case the cover is constituted by the housing of the opening cylinder 2. The spinning rotor 9 is provided with vent holes 10 designed for producing a necessary vacuum therein. However, such vent holes may be omitted and the vacuum effect can be produced by other means such as by a conical external wall of the spinning rotor, or by a foreign vacuum source. In its interior, the spinning rotor 9 has a sliding wall 11 merging into a collecting groove 12 for accumulating fibers into the form of a fibrous ribbon from which yarn is produced.

The cylindrical projection 6 supports a separator 13 which is coaxial with the spinning rotor 9. Through the separator 13 there is axially led a take-off duct 14 for withdrawing yarn 15 through the housing 16 of the fiber opening device. Yarn 15 is withdrawn by take-off rollers 17 disposed on the machine frame (not shown in the figures). The take-off duct 14 extends downward from the lower wall 18 of the separator 13 through a defining stud 19. The supply duct 5 which opens in the front wall 8 of the cylindrical projection 6 is oriented obliquely at an acute angle to said wall.

Figure 2:
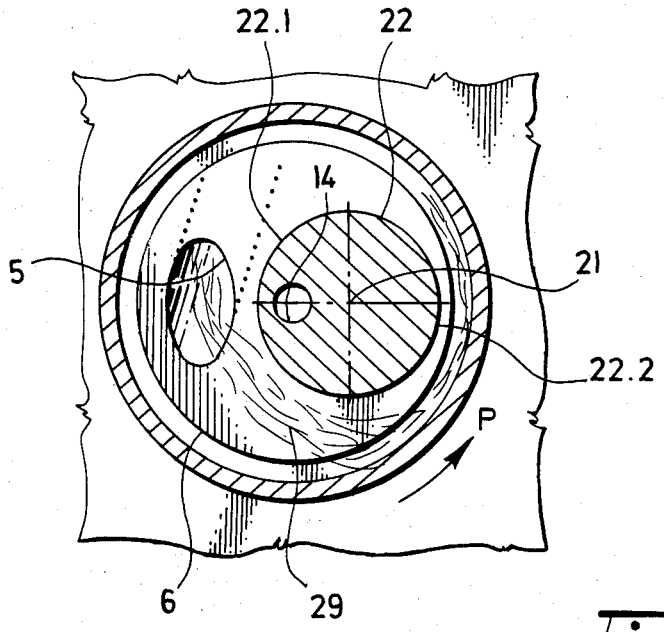
FIG. 2 is a sectional view taken along the line 2—2 in FIG. 1.

As can be seen in FIG. 2, the geometric center 21 of cross-sectional area of the defining stud 19 is eccentric relative to the take-off duct 14 and the cylindrical projection 6 whose axes are identical with the axis of spinning rotor 9. For the purpose of further description, the peripheral wall 22 of the defining stud 19 is divided into two sections, viz. an inner section 22.1 facing the outlet of supply duct 5, and an outer section 22.2 facing the opposite side of the cylindrical projection 6. The inner section 22.1 is curved in the direction of spinning rotor rotation (see arrow P) in order that fibers may follow a natural fiber motion trajectory, depending on their speed which is determined by the speed of ejected air flow and the spinning rotor revolution rate. The outer section 22.2 is either locally aligned with cylindrical wall 24 of the projection 6 (See FIGS. 3 and 4), or set back from it at a distance of up to 4 millimeters, in order to avoid a possible unwanted effect of the sliding wall 11 of spinning rotor 9 on the fiber flow.

Figure 3:
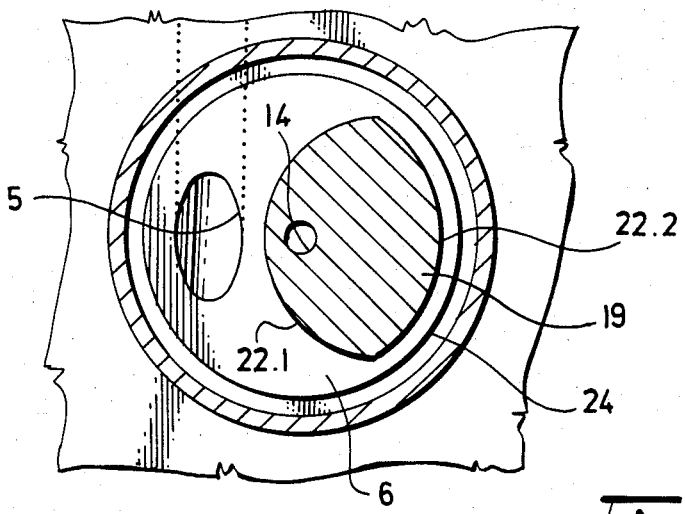
FIG. 3 is a sectional view similar to FIG. 2 of another embodiment of the defining stud.
Figure 4:
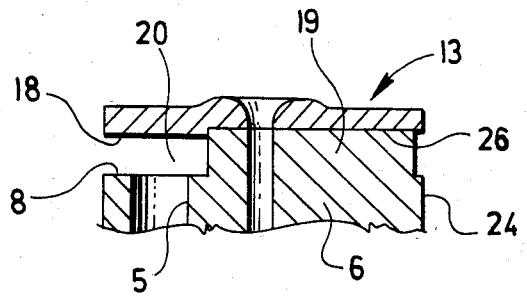
FIG. 4 is a detailed sectional view showing an alternative arrangement of the separator on the defining stud.

The peripheral wall 22 of defining stud 19 is of a cylindrical form which is the most preferable from the viewpoint of manufacture. However, the two sections 22.1 and 22.2 of said wall 22 can also be differently shaped such as in the form of cylindrical surfaces of different radiuses, for example as shown in FIG. 3. In the latter case, however, it is more preferable that the outer section 22.2 follows the edge of cylindrical wall 24 of projection 6 concurrently at a distance of from one to 4 millimeters. The inner section 22.1 extending between the take-off duct 14 and the supply duct 5, can be spaced apart from the adjacent edge of supply duct 5 at a distance of up to 5 millimeters, the radius of curvature of said inner section 22.1 being preferably the same, or smaller than that of the outer section 22.2. The inner section 22.1 can also have an elliptical form.

In the embodiment shown in FIG. 1, the defining stud 19 is an integral part of the separator 13 and engages into a recess 25 in the front wall 8 of the cylindrical projection 6 to avoid an undesirable effect of a horizontal gap between said two elements on the fibers supplied.

According to another embodiment (FIG. 4), the defining stud 19 supports the separator 13 and engages into a recess 26 provided in its lower wall 18.

Figure 5:
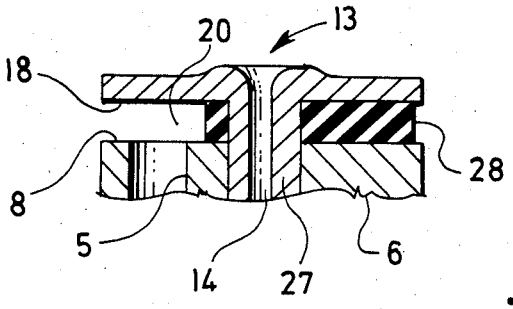
FIGS. 5 and 6 are detailed sectional views showing conventional separators provided with defining fillings of alternative embodiments, respectively.

However, one of the most preferred embodiments is shown in FIG. 5, wherein the defining stud 19 consists of a concentric shell 27 about the take-off duct 14 and a defining filling 28 which fills up a part of the space between the lower wall 18 of separator 13 and the front wall 8 of cylindrical projection 6. The defining filling 28 which is drawn over said concentric shell 27, is preferably made of an elastic material such as rubber or synthetics.

Figure 6:
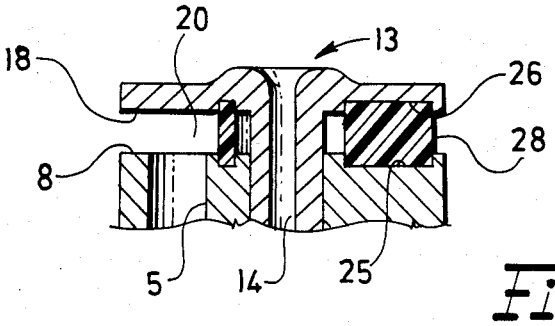

As can be seen in FIG. 6, the filling 28 can engage into both the recess 25 in the front wall 8 of cylindrical projection 6 and the recess 26 in the lower wall 18 of separator 13.

Referring to FIGS. 1 and 2, in operation, fibers, due to a vacuum produced by a fan effect of spinning rotor 9, or by a foreign source, enter the directing gap 20 between the separator 13 and the front wall 8 of cylindrical projection 6 and are carried along by air flow past the inner section 22.1 of peripheral wall 22 of defining stud 19 up to the sliding wall 11 of spinning rotor 9. The curved inner section 22.1 directs the air-borne fibers without any braking effect so that the fibers, having a sufficient speed, are deposited in a suitable form onto the sliding wall 11 of spinning rotor 9. Owing to the arrangement of defining stud 19, which fills up a part of the space between the separator 13 and the front wall 8 of cylindrical projection 6, there is eliminated a tendency to the production of a central air whirl which may cause the fibers to wrap around said stud 19. On the sliding wall 11, the fibers 29 slide to the collecting groove 12 in which they are condensed to the form of a fibrous ribbon which is twisted and withdrawn in the form of yarn 15 through the take-off duct 14 out of the spinning unit by the take-off rollers 17.

We claim:

1. An open-end spinning unit, comprising
a spinning rotor having an axis of rotation;
a cylindrical projection partially engaging into said spinning rotor;
a separator supported by said cylindrical projection;
a defining stud for defining a space between said separator and said cylindrical projection in a vertical direction, thereby defining a lower wall of said separator and a front wall of said cylindrical projection;
a fiber directing gap between the lower wall of said separator and the front wall of said cylindrical projection;
a fiber supply duct intersecting the front wall of said cylindrical projection at an acute angle; and
a fiber take-off duct passing through said separator, said cylindrical projection, and said defining stud;
said separator and said cylindrical projection being coaxial with each other and with the spinning rotor, the geometric center of cross-sectional area of said defining stud being situated eccentrically to the spinning rotor axis;
wherein the defining stud has a peripheral wall being divided into an inner section facing the supply duct, and an outer section situated at the opposite side of the cylindrical projection, said inner section being curved in a direction of natural fiber flow trajectory merging into a direction of the spinning rotor rotation and the outer section being in contact with or radially set back from the cylindrical wall of said projection at a distance of up to 4 millimeters;
wherein the peripheral wall of the defining stud has a length which corresponds to at least one half of an average staple length of fibers supplied through the supply duct.

2. An open-end spinning unit according to claim 1, wherein the peripheral wall of the defining stud is cylindrical.

3. An open-end spinning unit according to claim 1, wherein the inner section of the peripheral wall has a radius of curvature less than or equal to a radius of curvature of the outer section of the peripheral wall.

4. An open-end spinning unit according to claim 1, wherein the outer section of the peripheral wall follows the cylindrical wall of the projection concurrently at a distance ranging from one to 4 millimeters.

5. An open-end spinning unit according to claim 1, wherein the inner section of the peripheral wall is spaced apart from an adjacent edge of the supply duct at a distance of up to 5 millimeters.

6. An open-end spinning unit according to claim 1, wherein the defining stud is an integral part of the separator and engages into a recess in the front wall of the cylindrical projection.

7. An open-end spinning unit according to claim 1, wherein the defining stud is an integral part of the cylindrical projection and engages into a recess in the separator.

8. An open-end spinning unit according to claim 1, wherein the defining stud consists of a concentric shell about the take-off duct, and a defining filling for filling up a part of the space between the lower wall of the separator and the front wall of the cylindrical projection, said filling being drawn over the concentric shell.

9. An open-spinning unit according to claim 8, wherein the defining filling is made of elastic material.

10. An open-end spinning unit according to claim 8, wherein the defining filling engages into both a recess in the front wall of the cylindrical projection and a recess in the lower wall of the separator.

* * * * *